US006533657B2

(12) United States Patent
Monson et al.

(10) Patent No.: US 6,533,657 B2
(45) Date of Patent: Mar. 18, 2003

(54) LOW NOISE DUCT SYSTEM

(75) Inventors: Robert James Monson, St. Paul, MN (US); Trevor J. McCollough, Minneapolis, MN (US); Jianhua Yan, Prior Lake, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/853,220

(22) Filed: May 11, 2001

(65) Prior Publication Data

US 2002/0168933 A1 Nov. 14, 2002

(51) Int. Cl.[7] ..... F24F 7/007
(52) U.S. Cl. ..... 454/346; 454/906
(58) Field of Search ..... 454/251, 346, 454/184, 906; 181/224, 225; 312/326

(56) References Cited

U.S. PATENT DOCUMENTS

| | | | | | |
|---|---|---|---|---|---|
| 2,297,046 | A | | 9/1942 | Bourne | 181/48 |
| 3,363,532 | A | * | 1/1968 | Horneff | 454/187 |
| 3,759,157 | A | * | 9/1973 | Larkfeldt et al. | 181/24 |
| 4,319,661 | A | | 3/1982 | Proudfoot | 181/295 |
| 4,362,223 | A | * | 12/1982 | Meier | 181/206 |
| 4,554,766 | A | * | 11/1985 | Ziemer et al. | 454/187 |
| 4,600,078 | A | | 7/1986 | Wirt | 181/286 |
| 4,649,808 | A | * | 3/1987 | Ward et al. | 126/504 |
| 5,681,219 | A | * | 10/1997 | LeFevre et al. | 454/184 |
| 5,723,828 | A | * | 3/1998 | Nakagawa | 181/224 |
| 5,728,979 | A | * | 3/1998 | Yazici et al. | 181/224 |
| 5,733,320 | A | * | 3/1998 | Augustine | 454/906 |
| 6,174,231 | B1 | * | 1/2001 | Bodin | 454/184 |

* cited by examiner

*Primary Examiner*—Derek Boles
(74) *Attorney, Agent, or Firm*—Patrick M. Hogan; Glenn W. Bowen

(57) ABSTRACT

A system including a cabinet for intaking or discharging a gas while minimizing external duct noise and a gas duct for attachment to a housing with the gas duct having a smoothly curved passageway therein with each portion of the passageway having a cross sectional area which is sufficiently large so that the ratio of the inertia forces to viscous forces within the passageway is sufficiently small so that a laminar flow condition is maintained throughout the gas duct.

18 Claims, 1 Drawing Sheet

LOW NOISE DUCT SYSTEM

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

FIELD OF THE INVENTION

This invention relates generally to a system for sound reduction and more specifically to reducing the internal noise emanating from a gas duct by sizing the gas duct so as to maintain a laminar flow condition within the gas duct during operation of the system.

BACKGROUND OF THE INVENTION

One of the difficulties with equipment and particularly with equipment confined in equipment cabinets is that the flow of air in the duct system and particularly in sheet metal duct systems produces additional noise or amplifies noise already present in the cabinet. Various known methods of reducing emitted noise include placing sound absorber materials around the outside of the ducts or attempting to cancel out sound waves through interfering sound waves.

The present invention provides an improved method and apparatus for reducing internal duct noise by maintaining a flow of a gas to and from the cabinet in a laminar flow condition while at the same time redirecting the flow away from the cabinet. While laminar flow or turbulent flow in of itself does not necessarily increase the noise level it has been found that the duct housing, which surrounds the flowing gas can flutter and chatter as turbulent gas flows though the duct. The flutter and chatter is produced by the duct sidewalls that are normally made of sheet metal bending back and forth. While duct sidewalls flexing or buckling can occur to thermal changes it has been found that a substantial amount of the duct noise is due to the result of turbulent flow conditions within the duct.

The concept of laminar and turbulent flow is known in the art. Generally, when the ratio of inertia to viscous forces is below a critical level the flow is laminar and when the ratio of inertia to viscous forces is above a critical level the flow is turbulent. The critical level is often referred to as the Reynolds number. The critical Reynolds number, where laminar flow becomes turbulent flow, can vary with conditions of the passageway. In some instance laminar flow can be maintained up to Reynolds numbers in excess of 2000 and in other cases laminar flow can be maintained only if the Reynolds number is less than 1000. In addition to the laminar flow condition and turbulent flow condition there exists an intermediate condition known as "slug flow". Slug flow occurs when the flow alternates between laminar and turbulent flow. Turbulent flow and "slug flow" generally have pressure variations associated with the flow conditions. It should be understood that a reference to critical Reynolds number herein is meant to denote the Reynolds number where either "slug flow" or turbulent flow begins to occur.

It should be pointed out that while the pressure changes from laminar to turbulent flow do not necessarily directly generate unwanted noise the pressure consequences of the transformation from laminar to slug flow or to turbulent flow can cause the sidewalls of the duct to generate noise. That is, the pressures on the sidewalls of the gas duct can change abruptly as the fluid flow changes from a state of laminar flow to a state of turbulent flow or back again and the pressure can continue to fluctuate if the flow remains turbulent. As the ducts are generally lightweight material such as sheet metal it has been found that the ducts bend or buckle in response to the pressure changes thereby generating annoying duct noise.

In the present invention the gas flow within the ducts is maintained in a laminar flow condition while the gas flow is redirected from an inlet end of a gas duct to an outlet end of a gas duct. Consequently, ducts made from materials which would normally flex and flutter can now be maintained in non-buckling or a nonflexing condition to thereby minimize flow noise caused by the duct.

SUMMARY OF THE INVENTION

The invention includes a gas transfer system having a cabinet for intaking or discharging air while minimizing duct noise and in a separate embodiment a gas duct having one end for attachment to a housing with the gas duct having a smoothly curved passageway therein with each portion of the passageway having a cross sectional area which is sufficiently large so that the ratio of the inertia forces to viscous forces of the flowing gas within the passageway is sufficiently small so that a laminar flow condition is maintained throughout the gas duct.

DESCRIPTION OF THE INVENTION

Figure 1:
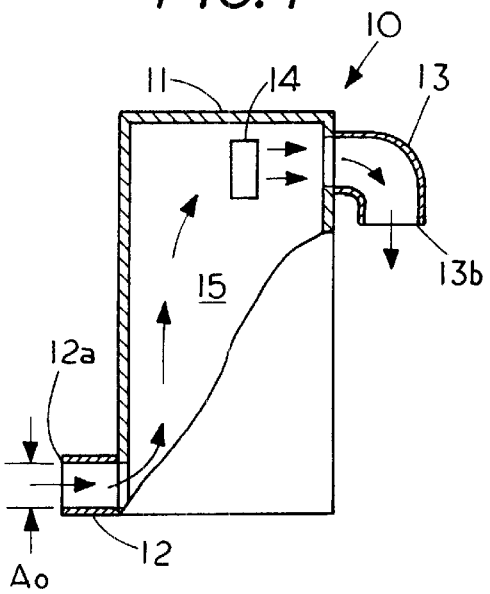
FIG. 1 shows a cabinet having an inlet duct and an outlet duct for directing cooling air from the cabinet.

FIG. 1 shows a cabinet cooling system 10 comprising a cabinet 11 partially in cutaway view. An inlet gas duct 12 connects to one side of cabinet 11 and directs a gas such as air into chamber 15. The gas directed into chamber 15 is normally air which is used to cool equipment within the cabinet 11. However, the gas can be a mixture of various gases or a single gas and can be used for either cooling or heating the contents of the cabinet. In most applications air is directed through chamber 15. A fan 14 in chamber 15 directs the air into a gas outlet duct 13 to discharge the air away from the cabinet. In most applications the air is directed downward so as not to blow directly on persons or objects in the immediate vicinity of the cabinet 11. As most cabinets are upright this requires that the gas duct be curved 90 degrees so that the gas being discharged can be directed from a horizontal flow condition to a vertical downward flow condition as illustrated in FIG. 1. In addition because of condensation moisture the discharge duct 13 is generally required to be directed downward so that any condensation will fall to the floor rather than on equipment or personal.

Figure 2:
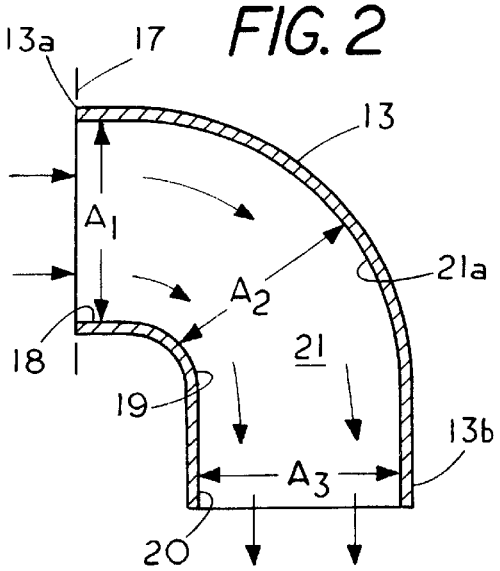
FIG. 2 shows a cross sectional view of the outlet duct of FIG. 1.

A reference to FIG. 2 shows an enlarged sectional view of gas duct 13. Gas duct 13 typically is made from sheet metal or the like and can take on various cross sectional shapes, for example, a rectangular or circular shaped passageway are often used. The gas outlet duct 13 is shown having a first end 13 with a flange 17 for attachment to an area to be vented and a second end 13*b* for discharging a gas therefrom. The curved gas duct 13 has an inlet end 18 of a first cross sectional area designated by $A_1$, an outlet end 20 of a second cross sectional area $A_3$ and a fluid passageway 21 having an intermediate region of a third cross sectional area $A_2$. The interior sidewalls 21*a* of passageway 21 smoothly connects the inlet 18 to the outlet 20. In the preferred embodiment the cross sectional areas along the passageway are sufficiently large so that ratio of inertia to viscous forces of the gas flowing therethrough is maintained in a laminar flow condition during maximum output from the fan 14 within the cabinet 11. That is, the cross sectional area of the gas outlet duct is sized to the fan capacity so that the velocity of the fluid entering the gas inlet 18 is sufficiently low so that the ratio of inertia forces to viscous forces in the fluid maintains the flow in a stable laminar flow as the gas enters inlet 18. The interior sidewalls of 21*a* of passageway 21 smoothly curve so as not to disrupt the laminar flow condition therein and the cross sectional area of the passageway 21 is maintained sufficiently large so as to maintain laminar flow through out the gas duct. This can be achieved in a number of ways in one application the cross sectional area of the gas duct remains constant thereby ensuring that the laminar flow in the inlet 18 is carried through to the outlet 20. In other conditions the cross sectional area of gas duct 13 can increase toward the discharge end 20 or even in some cases the discharge cross sectional area could decrease as long as the exit velocity is sufficiently low so that a stable laminar flow occurs. In any event the user will be able to determine the fan output and accordingly size the gas duct.

In the embodiment of FIG. 2 a fan 14 draws a gas through gas inlet duct 12 and discharges the gas into and through gas outlet duct 13 with the gas moving at a velocity so as to have a Reynolds number below the critical Reynolds number where laminar flow becomes turbulent flow. For purpose of the present invention the critical Reynolds number is the flow condition where "slug flow" or turbulent flow begins to occur, in other words in the region of laminar flow.

Figure 3:
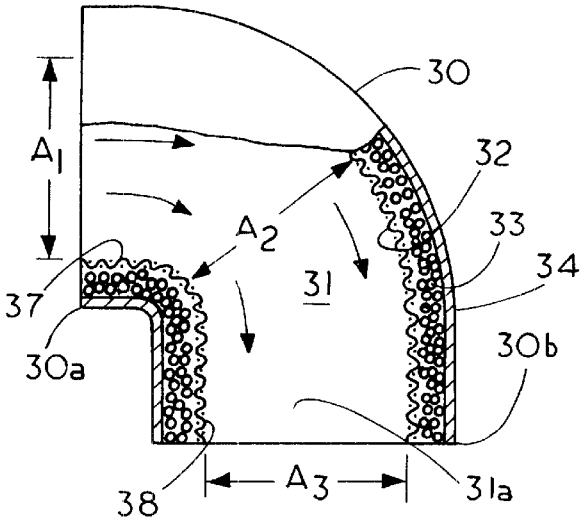
FIG. 3 shows an alternate embodiment of an outlet duct.

FIG. 3 shows a partial cross-sectional view of a gas duct 30 with a plurality of acoustic resonators 23 located in gas duct 30. The purpose of the embodiment shown in FIG. 3 is to reduce internal cabinet noise from equipment within the cabinet while at the same time inhibiting the noise generation due to flow through the gas ducts. The acoustic resonators 23 are held in position on one side of the gas duct by a sound penetrateable member such as a mesh liner 32. Located on the opposite side of acoustic resonators 33 is a second member 34 or outside panel or the like that forms a region 36 therebetween. A plurality of acoustic resonators 23 are located in a loosely packed condition in cavity 36 which is located between members 32 and 34. The plurality of acoustic resonators 23 comprise bead like members of different size and shape and each having at least one acoustical resonant cavity therein. The acoustic resonators 33 are stacked between members 32 and 34 so as to have the outside surfaces in contact with each other and generally have a shape so that the acoustic resonators provide at least some air space around each other if the acoustic resonators are randomly positioned therein. The acoustic resonators are held in position proximate each other through gravitational forces with spaces or gaps between the outer surfaces of the acoustic resonators thereby allowing the acoustic resonators to be displaced or move in response to generation of an acoustic wave within the acoustic resonator 33. In addition to the acoustic resonators 33 the positioning of the acoustic resonators 33 within the cabinet provides a torturous path for sound waves to pass therethrough. Our copending application titled Acoustical Attentuator and Method of Attenuation of Noise filed on even date herewith Ser. No. 09/853,219 more fully describes the acoustic resonators and is hereby incorporated by its entirety into the present application.

The curved gas duct 30 has an inlet 30*a* of a first cross sectional area designated by $A_1$, an outlet 30*b* of a second cross sectional area $A_3$ and a fluid passageway 31 having an intermediate region of a third cross sectional area $A_2$. The interior sidewalls 31*a* of passageway 31 smoothly connects the inlet 37 to the outlet 38. In the preferred embodiment the cross sectional areas through the passageway are sufficiently large so that ratio of inertia to viscous forces of the gas flowing therethrough is maintained in a laminar flow condition.

Figure 4:
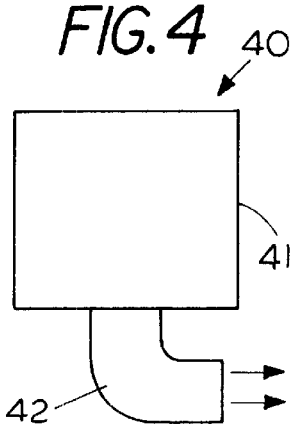
FIG. 4 shows a top view of a cabinet having a gas outlet duct with a compound curve.

FIG. 4 shows a top view of a cabinet cooling system 40 having a cabinet 41 with a gas duct 42 extending outward away from cabinet 40 to thereby direct discharged gas away from cabinet 41.

Figure 5:
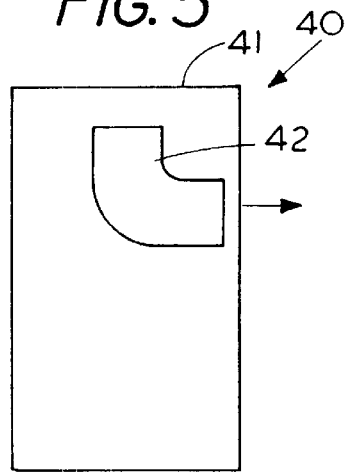
FIG. 5 is a front view of the cabinet and gas outlet duct of FIG. 4.

FIG. 5 shows a front view of cabinet cooling system 40 of FIG. 4 shown that the gas duct includes a compound curve. That is, the gas being discharged from cabinet 41 first flows perpendicular outward from cabinet 41 and then is directed downward before being deflected laterally away from cabinet 40. In either case the transverse cross sectional areas of the duct passageway are maintained such that the gas velocity is sufficiently low so that the gas flow does not change from laminar to slug flow or turbulent flow.

Thus the present invention comprises a method of reducing noise in a curved gas duct by generating a laminar flow of gas from a fan and forcing the gas into an inlet end of the curved gas duct, which has a transverse cross sectional area sufficiently large so as maintaining the ratio of inertia forces to viscous forces in the gas sufficiently low to thereby maintain the laminar flow condition at the inlet end. The intermediate transverse cross sectional area of the gas duct and the outlet transverse cross sectional area of the duct are also selected to be sufficiently large so as to maintain laminar flow as the gas duct curves from a first direction to a second direction through the gas duct. By selecting the size of the ducts to ensure a laminar flow condition within the duct it has been found that the emitted noise from a cabinet was reduced from 6 to 11 decibels which is a reduction of well over half the emitted noise from the cabinet.

We claim:

1. A cabinet cooling system comprising:

a cabinet;

a gas inlet duct, said gas inlet duct having an intake passageway in fluid communication with said cabinet;

a gas outlet duct, said gas outlet duct having an outake passageway in fluid communication with said cabinet; and a fan, said fan drawing a gas through said gas inlet duct and discharging said gas into and through said gas outlet duct at a Reynolds number below a critical Reynolds number where laminar flow becomes turbulent flow to thereby inhibit noise generation by flexing of a sidewall of the gas outlet duct.

2. The cabinet cooling system of claim 1 wherein a cross sectional area of the gas outlet duct along the gas outlet duct is constant.

3. The cabinet cooling system of claim 1 wherein the cross sectional area of the gas outlet duct along the gas outlet duct increases from an ingress to the gas outlet duct to an egress to the gas outlet duct.

4. The cabinet cooling system of claim 1 wherein the gas outlet duct is curved.

5. The cabinet cooling system of claim 4 wherein the gas outlet duct curves at least 90 degrees so that the direction of the gas flowing though said gas outlet duct rotates at least 90 degrees.

6. The cabinet cooling system of claim 1 wherein the gas outlet duct contains a plurality of acoustic resonators surrounding said gas outlet duct.

7. A cabinet cooling system comprising:

a cabinet;

a gas inlet duct, said gas inlet duct having an intake passageway in fluid communication with said cabinet;

a gas outlet duct, said gas outlet duct having an outake passageway in fluid communication with said cabinet and a plurality of acoustic resonators surrounding said gas outlet duct; said plurality of acoustic resonators each have an opening and an acoustical resonance cavity therein for ingress of a sound wave whereby the acoustical resonance cavity generates a resonance sound wave causing vibration displacement of each of said plurality of acoustic resonators thereby causing dissipation of the sound wave by conversion of acoustical energy into vibration energy; and, a fan, said fan drawing a gas through said gas inlet duct and discharging said gas into and through said gas outlet duct at a Reynolds number below a critical Reynolds number where laminar flow becomes turbulent flow to thereby inhibit noise generation by flexing of a sidewall of the gas outlet duct.

8. The cabinet cooling system of claim 5 wherein the gas outlet duct passageway rotates in at least two mutually perpendicular directions while maintaining a constant cross sectional area in the gas duct.

9. A curved gas duct having a first end for attachment to an area to be vented and a second end for discharging a gas therefrom, said curved gas duct having an inlet of a first cross sectional area, an outlet of a second cross sectional area and a fluid passageway forming an intermediate region of a third cross sectional area which smoothly connects the inlet to the outlet with the each of the cross sectional areas sufficiently large so that ratio of inertia to viscous forces of the gas flowing therethrough is maintained in a laminar flow condition.

10. The curved gas duct of claim 9 wherein the curved gas duct inlet includes a compound curvature.

11. The curved gas duct of claim 10 wherein each of the cross-sectional areas are substantially equal to each other.

12. The curved gas duct of claim 9 including a plurality of acoustic resonators surrounding said passageway in said gas outlet duct.

13. The curved gas duct of claim 9 wherein the gas duct comprises a sheet metal gas duct wherein the sheet metal flexes inward an outward in response to gas flow changing from laminar to turbulent flow.

14. The method of reducing gas discharge noise in a curved gas duct comprising:

forcing a gas into an inlet end of the curved gas duct, while maintaining the ratio of inertia forces to viscous forces of the gas sufficiently low so as to maintain laminar flow condition at the inlet end;

maintaining a cross sectional area of the gas duct downstream of the inlet end sufficiently large so as to sustain laminar flow therein as the gas duct curves from a first direction to a second direction to thereby inhibit fluttering and chattering of a sidewall of the gas duct.

15. The method of claim 14 including the step of directing a gas comprises directing a cooling air through a chamber of a cabinet.

16. The method of claim 14 including the step of directing gas into a chamber of a cabinet while maintaining a Reynolds number of the gas below a critical Reynolds number where laminar flow becomes turbulent flow.

17. The method of claim 14 including placing an acoustic resonator around the gas duct to absorb noise.

18. The method of claim 16 including the step of directing the gas horizontally outward from the cabinet and then vertically downward through the curved gas duct.

* * * * *